United States Patent [19]

Klee

[11] Patent Number: 4,800,728

[45] Date of Patent: Jan. 31, 1989

[54] METHOD AND APPARATUS FOR GAS FLOW CONTROL IN A CRYOGENIC FREEZER

[75] Inventor: David J. Klee, Emmaus, Pa.

[73] Assignee: Air Products and Chemicals, Inc., Allentown, Pa.

[21] Appl. No.: 99,443

[22] Filed: Sep. 18, 1987

[51] Int. Cl.[4] ..... F25D 13/06

[52] U.S. Cl. ..... 62/63; 62/186; 62/208; 62/374; 62/380

[58] Field of Search ..... 62/186, 203, 208, 374, 62/380, 63

[56] References Cited

U.S. PATENT DOCUMENTS

| | | | |
|---|---|---|---|
| 3,345,828 | 10/1967 | Klee et al. | 62/63 |
| 3,403,527 | 10/1968 | Berreth et al. | 62/266 |
| 3,613,386 | 10/1971 | Klee | 62/64 |
| 3,813,895 | 6/1974 | Klee et al. | 62/266 |
| 3,892,104 | 7/1975 | Klee et al, | 62/186 |
| 4,276,753 | 7/1981 | Sandberg et al. | 62/380 |
| 4,528,819 | 7/1985 | Klee | 62/63 |

*Primary Examiner*—Ronald C. Capossela

*Attorney, Agent, or Firm*—James C. Simmons; William F. Marsh

[57] ABSTRACT

Method and apparatus for controlling gaseous cryogen flow through a continuous tunnel type freezer wherein the cryogen and product to be frozen travel in counter-flow heat exchange relation to minimize egress of cryogen from, or ingress of ambient air into the product discharge opening in the freezer.

10 Claims, 2 Drawing Sheets

METHOD AND APPARATUS FOR GAS FLOW CONTROL IN A CRYOGENIC FREEZER

TECHNICAL FIELD

The present invention relates to tunnel-type cryogenic food freezers such as shown and described in U.S. Pat. No. 3,892,104, wherein the product (e.g. food) to be refrigerated and in some cases frozen moves through an elongated tunnel counterflow relationship to vapors of the cryogen used to effect final freezing of the product.

BACKGROUND OF THE PRIOR ART

One of the more prevalent types of freezers used to provide cryogenic freezing of a product (e.g. foodstuffs) is a continuous, in-line tunnel that utilizes liquid nitrogen as an expendable refrigerant. One such apparatus in commercial use is shown in U.S. Pat. Nos. 3,813,895 and 3,892,104, the specifications of both patents being incorporated herein by reference. The apparatus of the prior art can achieve high thermal efficiency because it is designed as a counterflow heat exchanger. The product moves through the tunnel on a continuous belt from an entry end (portal or opening) to a discharge end (portal or opening). Liquid nitrogen is sprayed onto the food product at a location adjacent to the discharge end (opening) of the freezer. The cold nitrogen gas, at −320° F. (−196° C.), evolved in the liquid nitrogen spray zone, moves through multiple zones of gas recirculation as it flows toward the entrance of the freezer. Since the maximum available refrigeration has been utilized at that point, the warmed nitrogen gas can then be vented to the outside atmosphere by an exhaust fan placed proximate the entry end of the tunnel.

Liquid nitrogen that is in equilibrium at 35.0 psia (241 kpa) has a latent heat of 80.5 BTU/lb. (187 J/g) when vaporized at atmospheric pressure. When the product enters the freezer at 75° F. (24° C.), the nitrogen gas will leave the freezer entrance at approximately 0° F. (−18° C.) in a freezer such as shown in the aforementioned patents and offered for sale by Air Products and Chemicals, Inc. as a CRYO-QUICK freezer. At these conditions the freezer is operating at optimum thermal efficiency and the nitrogen gas will have a sensible heat of 79.5 BTU/lb. (185 J/g). Thus, the liquid nitrogen has a total available refrigeration of 160 BTU/lb. (372 J/g). Since the sensible heat of the nitrogen gas is almost one-half of the total available refrigeration, it is necessary to provide correct nitrogen gas flow through the freezer to achieve high thermal efficiency.

The amount of liquid nitrogen injected into the freezer will depend upon the amount of refrigeration required by the product to be frozen (e.g. foodstuff). Further, whenever production is interrupted, the liquid nitrogen flow rate should be reduced substantially to maintain the freezer at its operating temperature. In a typical CRYO-QUICK freezer, having a conveyor belt 28" (711 mm) width and a length of 66' (20 m), the liquid nitrogen flow rate will vary from 3065 to 358 lb/hr (1390 to 162 kg/hr). In addition, the most efficient operation is obtained when the liquid nitrogen flow is shut off completely during the production interruption. If the production is stopped for a long period of time, then liquid nitrogen is readmitted to the freezer based upon the temperature within the freezer. Thus, the nitrogen gas flow through the freezer must change over a wide range from the maximum flow to zero flow.

If the gas flow control system moves a larger volume of gas than the amount of gaseous nitrogen evolved in the liquid nitrogen spray zone, warm room air will be pulled into the discharge opening of the freezer. The entry of warm room air will be a significant heat input, causing a loss of thermal efficiency. Further, the moisture contained in the room air will result in frost and ice accumulation within the freezer and impair its performance. If the gas flow control system moves a smaller volume than required, cold nitrogen gas will spill out of the discharge opening, causing a significant loss in thermal efficiency. Also, the nitrogen gas spilling into the processing room can cause an oxygen deficient condition that could result in a serious safety hazard.

In early freezers represented by U.S. Pat. No. 3,345,828, to insure that the cold gas would flow countercurrent to the product flow, parallel fans were employed in the tunnel. A thermocouple placed at the collection point of cold gas, where it interfaces with warm gas, was used to detect the level of the hot/cold interface and to change position of a damper (76) to equalize volume of circulation between the parallel flow fans. While this method proved satisfactory for freezers employing parallel flow fans, patentees in U.S. Pat. No. 3,403,527 improved this apparatus by employing additional dampers with the parallel flow fans.

Subsequent to the early parallel flow fan type freezers, it was discovered that a radial flow fan could be used to force the gas in countercurrent flow to the product. U.S. Pat. No. 3,813,895 discloses the type of freezer using all radial fans wherein a curved damper, which is temperature actuated, can be used to control the total flow of gas in the freezer. However, it was found that this apparatus performed satisfactorily on freezers of small dimensions (e.g. tunnel length of 22 ft. or less). The patentees in U.S. Pat. No. 3,892,104 employed a centrifugal fan to move the cold cryogen toward the entry end of the tunnel. Control of the fan and hence control of the movement of gas through the tunnel was effected by sensing the spray header pressure which in turn controlled the speed of the fan.

U.S. Pat. No. 4,528,819 discloses an immersion-type cryogenic freezer suitable for freezing foodstuffs wherein movement of the vaporized cryogen is in concurrent flow with the movement of the product through the freezer. Patentees disclose control of an exhaust fan to control the direction of vaporized nitrogen flow, which in turn prevents air insufflation into the freezer. However, an exhaust fan cannot be used effectively in a tunnel type freezer to move the vaporized cryogen through the freezer. When the freezer is more than 30 ft long, the exhaust fan is unable to move a sufficient volume of vaporized cryogen through the freezer. Although an exhaust fan could be used on smaller freezers, the exhaust fan will also pull room air through the entry end opening of the freezer. When moist room air is mixed with the vaporized cryogen, the moisture will become frost that will clog the exhaust duct. This condition is most severe when the vaporized cryogen is colder than −50° F. and the relative humidity of the room air is greater than 50%.

U.S. Pat. No. 3,613,386 discloses and claims a control system for regulating liquid nitrogen flow in a cryogenic freezer. The control system disclosed in the U.S. Pat. No. 3,613,386 patent is used in the radial-type freezers sold today and can be utilized with the control system of the present invention.

The commercial CRYO-QUICK freezer employs a gas flow control system such as described in U.S. Pat. No. 3,892,104. A freezer of this type with variable speed gas control system directs the flow of vaporized nitrogen by sensing the pressure in the liquid nitrogen spray header. The pressure signal is then used to change the speed of the gas control blower, which in this case is a centrifugal fan. This system, although it will operate correctly during continuous production, has several disadvantages. When the food product first enters the freezer, the pressure drop through the freezer changes until the conveyor belt is completely covered through its entire path inside the freezer. As a result, the freezer operator must adjust the maximum speed potentiometer each time production is started. In the same manner, the flow condition throughout the freezer changes whenever production is stopped. Thus, the freezer operator must again adjust the maximum speed potentiometer as the freezer is emptied of product. Experienced users of this type of equipment have found the pressure drop through the freezer changes for different food products. Thus, when different food products are loaded into the freezer, the freezer operator must readjust the maximum speed potentiometer to achieve correct nitrogen gas flow through the freezer. If the equilibrium conditions of the liquid nitrogen, as indicated by the liquid nitrogen storage tank pressure, change significantly, the quality of the liquid nitrogen flowing through the spray nozzles will also change. It is for this reason that the liquid nitrogen spray header pressure will be different for the same liquid nitrogen flow rate. This same condition will obtain if the liquid nitrogen spray nozzles become clogged with debris. Under these circumstances the freezer operator must then readjust the maximum speed potentiometer to achieve correct gas flow. The most serious disadvantage of the present system is that it requires the freezer operator to adjust the maximum speed potentiometer for proper operation. If the freezer operator adjusts the system incorrectly, the freezer will operate inefficienty until the system is readjusted.

BRIEF DESCRIPTION OF THE INVENTION

It has been discovered that the total flow of cryogen gas through the continuous cryogenic food freezer can be effected by placing a thermocouple adjacent to or at the discharge opening of the freezer. The thermocouple is in turn connected to a temperature controller which in turn is connected to a motor controller which motor controller controls the speed of the motor which powers the gas flow control fan in the tunnel. The thermocouple can sense the presence of the vaporized cryogen or ambient air at the discharge opening of the freezer. If room air is being pulled into the discharge opening of the freezer, the temperature will approach that of the processing room, e.g. 75° F. (24° C.). If cold nitrogen gas spills out of the discharge opening, the temperature will approach −320° F. (−196° C.). Thus, the correct gas flow condition can be achieved at some temperature level between these limits. Optimum setpoints can be arrived at for a particular product with a minimum of operator intervention. When a particular setpoint is identified for a particular product, then subsequent freezing runs can be effected by programming the setpoint into the temperature controller.

DETAILED DESCRIPTION OF THE INVENTION

Figure 1:
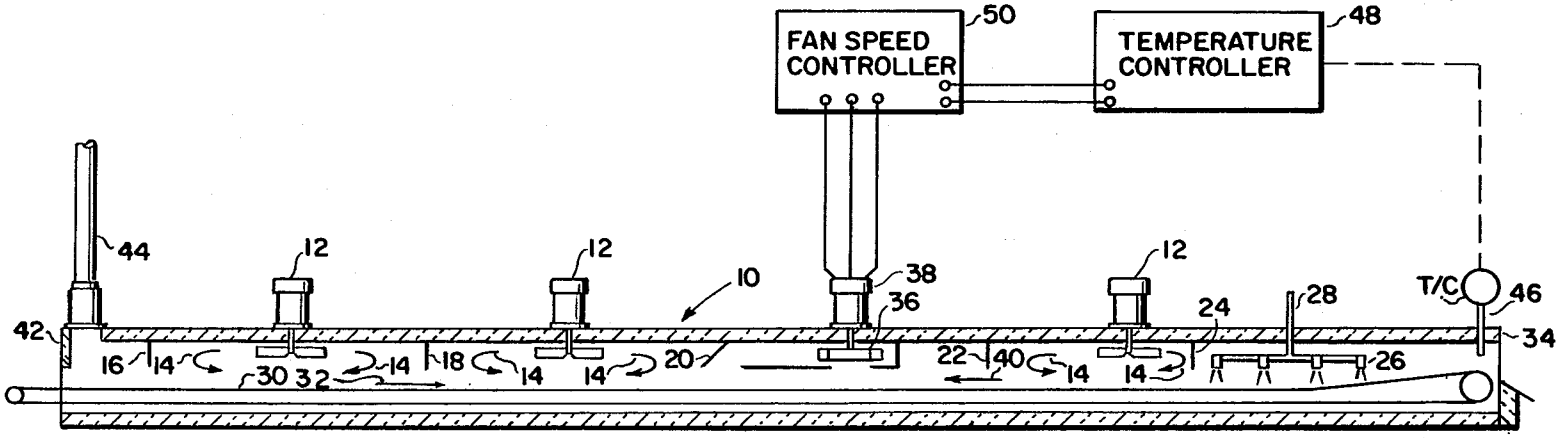
FIG. 1 is a schematic representation of a freezer to which the present invention has been applied.

Referring to FIG. 1, the numeral 10 depicts a cryogenic freezer or tunnel of the type shown in U.S. Pat. Nos. 3,813,895 or 3,892,104. Freezer or tunnel 10 includes a plurality of recirculating fans powered by a recirculating fan motor, each of which is shown as 12. Each of the recirculating fan and motor assemblies 12 recirculates vaporized cryogen inside the tunnel in accordance with the arrows 14, the recirculation paths being defined by a plurality of baffles 16, 18, 20, 22 and 24 disposed within the freezer in a manner adequately described in the prior art. Liquid cryogen (e.g. liquid nitrogen) is injected into the freezer means of a spray header 26 and a liquid cryogen 28 (liquid nitrogen) conduit connected thereto. Liquid cryogen conduit 28 is in turn connected to a suitable source of supply such as a liquid cryogen tank (not shown) by means of piping as is known in the art. Disposed inside freezer 10 is a conveyor belt 30 which causes movement of product placed thereon in the direction shown by arrow 32. The liquid nitrogen spray header 26 is disposed near the discharge end 34 of freezer 10. Liquid nitrogen sprayed from the header 26 vaporizes causing a buildup of vaporized cryogen inside the tunnel 10 in the area adjacent to spray header 26. A gas control fan or blower 36 driven by a variable speed motor 38 causes the vaporized cryogen to move through the tunnel in the direction shown by arrow 40. The means of baffling and types of fans suitable for this purpose are also adequately described in the prior art. The freezer or tunnel 10 includes a product entry end 42 adjacent to which is placed an exhaust duct 44. Exhaust duct 44 can include a suitable exhaust fan and is usually vented outside of the immediate area of the freezer to prevent oxygen depletion in the ambient atmosphere in which the freezer 10 is used.

Disposed adjacent the exit end 34 of the tunnel 10 is a thermocouple 46 which is connected to a temperature controller 48 which in turn is connected to a fan speed controller 50.

Figure 2:
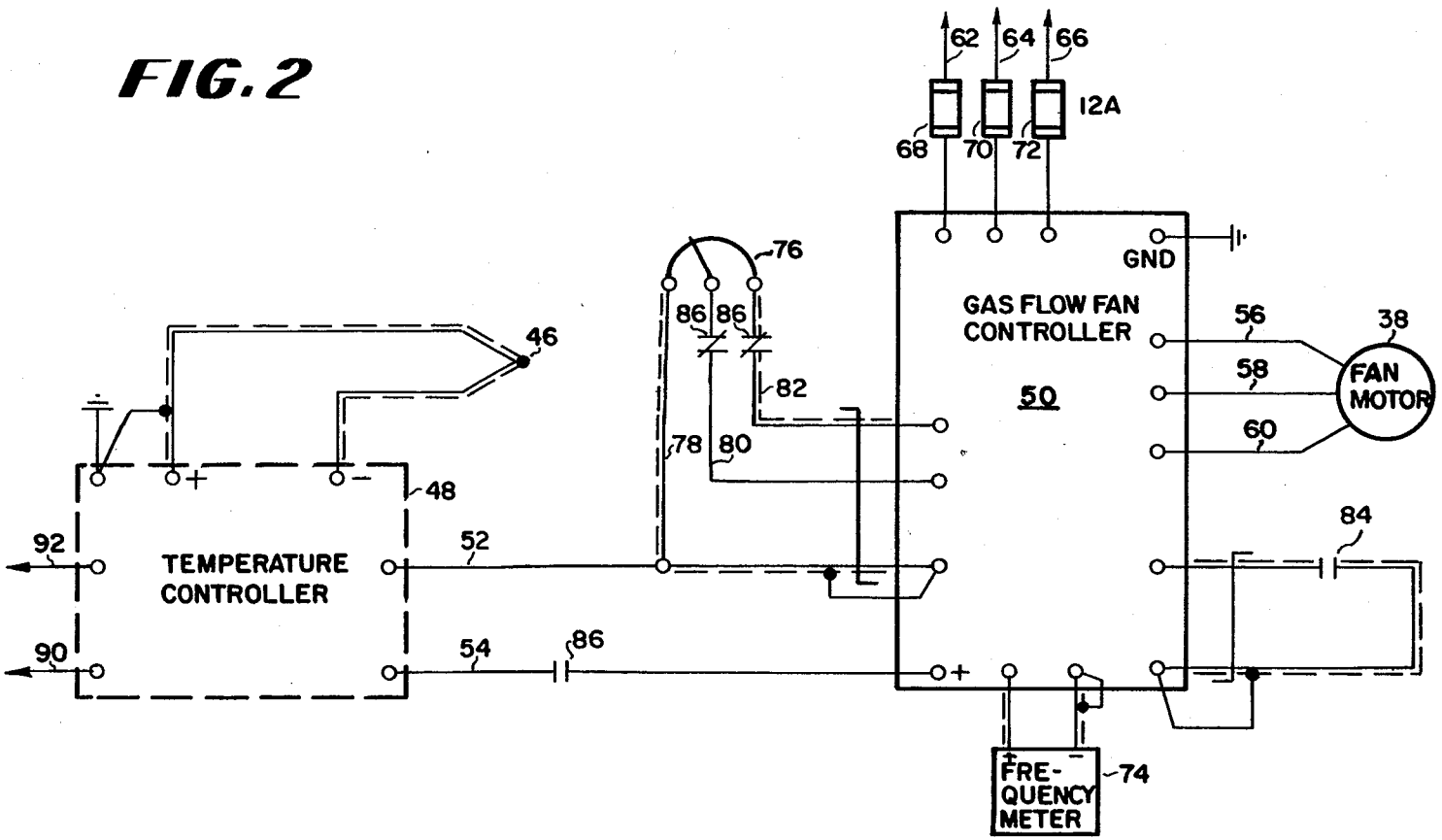
FIG. 2 is a simplified circuit drawing for the apparatus of the present invention.

Referring now to FIG. 2, the thermocouple 46 is of a suitable type such as copper/constantan in order to be useful over a temperature range from −320° F. (196° C.) to ambient, e.g. 75° F. (24° C.). Thermocouple 46 is the input for a temperature controller 48 which in the preferred embodiment of the invention is a temperature controller, proportional with automatic reset, such as Series 900 manufactured and sold by Thermo Electric Company of Saddle Brook, N.J. The output through leads 52 and 54 of the temperature controller 48 are the input for the gas flow fan speed controller 50. Controller 50 in turn has output leads 56, 58 and 60 which are input for fan motor 38. In the case where the fan 36 is driven by an alternating current motor, the gas flow fan controller 50 can be an AC inverter such an AFC-2000 series offered for sale by T. B. Wood's Sons of Chambersburg, Pa. The output of the gas flow fan controller (inverter) 50 can be 1 to 60 hertz (Hz) and is connected to the standard AC motor which in a preferred embodiment of the invention is an AC motor rated at 1750 rpm.

The entire system consisting of the thermocouple, temperature controller and gas flow fan controller (46, 48 and 50) receives power through conventional power leads 62, 64 and 66 which contain suitable short circuit protection (e.g. fuses 68, 70 and 72). A frequency meter 74 can be connected to the gas flow fan controller 50 to give an indication of the speed of rotation of the motor 38. A potentiometer 76 having suitable taps 78, 80 and 82 is wired to the gas flow fan controller 50 in a known manner to provide manual operation of the gas control fan motor 38. A start circuit 84 is included which incorporates a suitable contact relay to energize the entire control system. The control system shown in FIG. 2 can be integrated to the overall control system shown in U.S. Pat. No. 3,613,386 by means of leads 90 and 92 to afford both liquid nitrogen delivery control and total gas flow control through the freezing tunnel 10.

As is well known in the art the control system of FIG. 2 can be wired so that it can be operated automatically or manually. This is achieved by using a push button and relays or relay shown as 86 in the circuit with potentiometer 76 so that energizing the relays 86 will put the system in automatic operation. Conversely, if the relays are open by being de-energized, the system can be operated manually by varying potentiometer 76.

The circuit of FIG. 2 can be constructed using a push button with contact blocks in place relay 86. The apparatus of the present invention functions so that the thermocouple 46 detects the temperature of the freezer at the location shown in FIG. 1. If room or ambient air is being pulled into the discharge opening 34 of freezer 10, the temperature will approach that of the processing room, e.g. 75° F. (24° C.). If on the other hand excess nitrogen gas builds up inside the freezer 10 and spills out of discharge opening 34, the temperature sensed by thermocouple 46 will approach −320° F. (−196° C.). Thus, the correct gas flow condition can be achieved at a temperature level between these limits.

For example, the proportional temperature controller referred to above provides a constant output of approximately 12 milliamperes when the actual temperature equals the setpoint of the controller. At this input the AC inverter identified above provides an output frequency of about 30 Hz which in turn drives the gas flow blower motor 38 to turn at about 875 rpm. If cold nitrogen gas spills out of the discharge opening 34, the temperature will become colder, increasing the output of the temperature controller 48. The AC inverter 50 then increases its output frequency to drive the gas control blower 38 faster, thus pumping more nitrogen toward the freezer entrance 42. Conversely, if any room air is pulled into the discharge opening, the temperature at the location of the thermocouple will become warmer, thus decreasing the output of temperature controller 48. This in turn will cause the output of the fan speed controller (AC inverter) 50 to decrease to thus slow down the gas control blower permitting nitrogen to prevent ingress of the room atmosphere.

In a laboratory test, the AC motor set out above operated at 60 Hz (1750 rpm) when the actual temperature was 69° F. (38° C.) colder than the setpoint. The AC motor stopped running when the actual temperature was 48° F. (27° C.) warmer than the setpoint.

A gas flow controller according to the present invention was installed in a commercial operation. The control was added to an existing CRYO-QUICK freezer and the freezer was used to process 2500 lbs/hr (1134 kg/hr) of chicken croquettes and sauce. During this processing run the following data was recorded:

Discharge Opening Temperature −41° F. (−40.6° C.)
Temperature Controller Setpoint −40° F. (−40° C.)
AC Inverter Output 26 Hz
Liquid Nitrogen Spray Header Pressure 6.4 psi (44 kPa)

The foregoing operating parameters provided the correct gas flow to the freezer, thus minimizing ingress of ambient air into the tunnel, or egress of vaporized cold nitrogen gas from the tunnel. During the run, as the liquid nitrogen output varied and the gas flow conditions changed, the AC inverter output varied between 0 to 26 Hz. However, the gas flow through the freezer remained correct at all times.

As set out before, the temperature controller setpoints may vary depending upon the product being frozen. However, this setpoint can be easily determined to maintain the proper gas flow through the freezer for subsequent processing runs.

The improved gas flow control system of the present invention has several advantages over the systems shown in the prior art. In view of the fact that the system of the present invention detects the relative movement of gas at the discharge opening, it will automatically correct for changing flow conditions within the freezer, such as when loading or unloading a product. In the same manner, it will automatically compensate for different product type. Changes in the liquid nitrogen quality delivered to the liquid nitrogen spray header will not effect the performance of the gas flow control since it operates independently thereof.

The most important and surprising advantage of the new system is that it does not require the freezer operator to readjust the system on a continuous basis. Furthermore, it does not require the operator's judgement of the correct gas flow condition since the temperature controller has a specific setpoint that remains unchanged.

Although the preferred embodiment of the invention discloses the use of an AC inverter to drive a standard AC motor, alternatively a DC motor control could be used to drive a DC motor, which in turn controls the speed of rotation of the fan should that be desirable for a given freezer.

Other types of motors and motor controls could be used so long as the net effect on one hand is that as cold nitrogen gas exits the discharge opening of the tunnel, the system must act to increase the speed of rotation of the gas control fan or blower to maintain zero flow conditions at the discharge opening. On the other hand, as room air enters the discharge opening, the system must act to slow down the speed of rotation of the gas control fan or blower and eventually to stop the rotation of the fan should conditions so indicate so that room air can be excluded from the freezer during normal operation.

Having thus described my invention what is described to be secured by Letters Patent of the United States is set forth in the appended claims.

I claim:

1. In a cryogenic freezer for refrigerating a product wherein said freezer comprises a generally elongated insulated tunnel including a conveyor belt for moving product from an entry end to a discharge end, a liquid cryogen injection system located near said discharge end of said tunnel and gas control fan means to move cryogen vaporized by contact with said product in counterflow heat exchange with said product, the improvement comprising:

a thermocouple disposed at the discharge end of said tunnel;

a temperature controller having an input connected to said thermocouple and an output adapted to be connected to a motor controller; and a motor controller having an input connected to the output of said temperature controller and an output adapted to vary the speed of rotation of said gas control fan whereby when said thermocouple senses ingress of ambient air into or egress of vaporized cryogen out of said tunnel said motor controller varies the speed of rotation of said gas control fan to prevent ingress of ambient air or egress of vaporized cryogen.

2. An apparatus according to claim 1 wherein said temperature controller is proportional with automatic reset.

3. An apparatus according to claim 1 wherein said motor controller is an alternating current inverter and said gas control fan is driven by an alternating current motor.

4. An apparatus according to claim 1 wherein said motor controller is a direct current controller and said gas control fan is driven by a direct current motor.

5. An apparatus according to claim 1 wherein said thermocouple is of the copper-constantan type.

6. An apparatus according to claim 1 wherein said thermocouple, temperature controller, and motor controller are integrated into the overall control system for said freezer.

7. In a process for quick freezing a product utilizing a vaporizing cryogen passed in counterflow heat exchange with said product passing through a freezer having an entry portal and an exit portal, the improvement comprising:

sensing the temperature at the exit portal of said freezer to determine if vaporized cryogen is exiting said freezer or if ambient atmosphere is entering said freezer through said exit portal; and varying the total flow of vaporized cryogen in counterflow heat exchange with said product to prevent excessive egress of said vaporized cryogen from or ingress of ambient atmosphere into said freezer.

8. A process according to claim 7 wherein said total flow of vaporized cryogen is controlled by a variable speed fan.

9. A process according to claim 7 wherein said total flow of vaporized cryogen is controlled automatically by using a variable speed fan in conjunction with a thermocouple disposed at the exit portal of said freezer and a controller to vary the speed rotation of the fan in relation to temperature sensed at the exit portal of said freezer.

10. A process according to claim 8 wherein said variable speed fan is controlled by a fan controller wired to a temperature controller which in turn is wired to a thermocouple disposed at the exit portal of said freezer.

* * * * *